United States Patent [19]

Arndt et al.

[11] Patent Number: 5,038,668

[45] Date of Patent: Aug. 13, 1991

[54] HYDRAULIC STRIKING MECHANISM

[75] Inventors: Friedrich-Karl Arndt; Robert Bartels, both of Essen, Fed. Rep. of Germany

[73] Assignee: Krupp Maschinentechnik GmbH, Essen, Fed. Rep. of Germany

[21] Appl. No.: 512,383

[22] Filed: Apr. 20, 1990

[30] Foreign Application Priority Data

Apr. 27, 1989 [DE] Fed. Rep. of Germany ..... 3913866

[51] Int. Cl.[5] ..... F01L 25/04

[52] U.S. Cl. ..... 91/290; 91/300; 91/319; 91/321; 91/299

[58] Field of Search ..... 91/290, 300, 319, 321, 91/235, 417 R, 299

[56] References Cited

U.S. PATENT DOCUMENTS

| | | | |
|---|---|---|---|
| 3,908,373 | 9/1975 | Peterson | 91/321 X |
| 3,925,985 | 12/1975 | Peterson | 91/321 X |
| 4,230,019 | 10/1980 | Castejon Castan | 91/321 X |
| 4,370,916 | 2/1983 | Mitin et al. | 91/417 R X |
| 4,646,854 | 3/1987 | Arndt et al. | 91/321 X |
| 4,784,228 | 11/1988 | Ito | 91/321 X |
| 4,796,428 | 1/1989 | Hall | 91/417 X |
| 4,817,737 | 4/1989 | Hamada et al. | 91/235 X |
| 4,951,757 | 8/1990 | Hamada et al. | 91/235 X |

FOREIGN PATENT DOCUMENTS

| | | |
|---|---|---|
| 2951794 | 7/1980 | Fed. Rep. of Germany . |
| 2904371 | 8/1980 | Fed. Rep. of Germany . |
| 3228894 | 3/1984 | Fed. Rep. of Germany . |
| 2941443 | 7/1985 | Fed. Rep. of Germany . |
| 3106410 | 7/1985 | Fed. Rep. of Germany . |
| 2175781 | 10/1973 | France . |
| 2291374 | 11/1974 | France . |

*Primary Examiner*—Edward K. Look
*Assistant Examiner*—Todd Mattingly
*Attorney, Agent, or Firm*—Spencer & Frank

[57] ABSTRACT

The invention relates to a hydraulic striking mechanism including a cylinder, a percussion piston guided therein and a piston return device which is supported on the percussion piston and is displaceable independently thereof and can be connected on its side facing the percussion piston tip alternatingly to a pressure source or a pressure-free return conduit. The piston return device is configured as an annular piston which is freely displaceable along the percussion piston and the cylinder and forms therewith a piston chamber. The percussion piston has an abutment face at its end remote from the percussion piston tip which cooperates with the annular piston for moving percussion piston in the return stoke direction. The percussion piston, together with the cylinder, defines an oil chamber which axially follows the piston chamber in a spaced relationship. The percussion piston is provided with a cylindrical shoulder within the oil chamber which determines its end position during the return stroke. The piston chamber and the oil chamber are connected with a control unit by means of which, when the percussion piston shoulder approaches the rear face of the oil chamber, the oil chamber can be connected to the return conduit and by way of which, when the annular piston approaches an annular face on the cylinder, the piston chamber can be connected with the pressure source.

15 Claims, 6 Drawing Sheets

3c
3
3a
6
5
8c
8a
8
8d
11a
9
8b
1b
10a
3b
7
12a
12c
1
12
1c
1d
12b
15
4
1a
2
30
17
30a
22
16
A1
A2
10
20
20a
A3
23
20b
24
25
28
29
14b
11
26
A4
27
28a
11b
A5
13
13a
14
19a
19
29a
21
P
18
14a

HYDRAULIC STRIKING MECHANISM

BACKGROUND OF THE INVENTION

The present invention relates to a hydraulic striking mechanism including a cylinder, a percussion piston guided therein and a piston return device, with the percussion piston being charged on one side with a pressurized compressible driving medium (compressed gas). The piston return device is supported on the percussion piston so as to be displaceable independently of the percussion piston and returns the piston in a direction opposite to the direction of its operating or striking stroke. On its side facing the tip of the percussion piston, the piston return device is alternatingly connected to a pressure source for an incompressible driving medium (hydraulic oil) and to a pressure-free return conduit.

In spite of their otherwise differing operating modes, the prior art striking mechanisms have in common that the incompressible driving medium is directly coupled with the facing piston surfaces of the percussion piston. Movement of the percussion piston displaces the incompressible driving medium (i.e. the hydraulic oil) from the area in front of the one piston face and causes it to be replenished behind the other. The columns of fluid upstream and downstream of the two piston faces travel at the same speed as the percussion piston itself.

When the percussion piston hits the connected chisel or, for a direct strike, the material to be worked, the percussion piston is suddenly decelerated. The fluid column upstream of the piston face continues its movement in the direction o the strike; this produces the danger of cavitation. The sudden deceleration of the percussion piston and of the fluid column creates considerable pressure peaks at the opposite piston face. The direct coupling of the incompressible driving medium with the movement of the percussion piston is additionally a drawback in that the flow cross sections in the associated channels and in the control unit must be adapted to the greatest occurring piston velocity.

German Patent No. 2,941,443 [corresponding to U.S. Pat. No. 4,370,916] discloses a striking mechanism of the above-mentioned type which includes a piston return device that encloses the percussion piston in a spaced arrangement on the side facing away from the percussion piston tip and is in communication with piston rods on its side facing the percussion piston tip. The piston rods are components of cylinder units that are separate from the operating cylinder and serve to drive the piston return device in a direction opposite to the direction of the operating stroke of the percussion piston, that is, opposite to the striking direction, and thus return it. The fact that a resiliently supported latch is incorporated in the piston return device so as to be locked with the percussion piston makes it possible to take the percussion piston along in a direction opposite to the striking direction. During the operating stroke of the percussion piston in the striking direction, as soon as the latch is released from the percussion piston, the piston return device is set free and hurries after the percussion piston in the striking direction. The drawback of this prior art striking mechanism is that the coupling in and out of the piston return device, which is a mechanical action, is complicated from a manufacturing point of view and subject to malfunctions. Due to the relatively large masses of the combined interacting components, the piston return device permits striking rates only in an order of magnitude of no more than 60/min.

SUMMARY OF THE INVENTION

It is an object of the present invention to provide a striking mechanism having a piston return device which is decoupled during the operating stroke of the percussion piston, is of the simplest possible configuration and, in particular, has hardly any mechanically active accessory components and which permits high striking rates with the smallest possible mass.

It is another object of the invention to provide a striking mechanism of the above type in which the piston return device is configured so that it can be decelerated independently of the impact of the percussion piston.

It is a further object of the invention to provide a striking mechanism of the above type in which it is possible to continuously adjust the piston stroke and thus the striking energy as well as the number of strikes.

The above and other objects are accomplished according to the invention by the provision of a hydraulic striking mechanism, including: a cylinder including an interior surface having first and second oppositely facing annular faces; a percussion piston guided in the cylinder and being movable in the cylinder in one direction for performing a striking stroke and in an opposite direction for performing a return stroke, the percussion piston including a first end having a striking tip for striking an object during the striking stroke, and an opposite, second end presenting an axial abutment face and being charged with a compressible driving medium, the percussion piston defining, with the cylinder, an oil chamber and having a cylindrical shoulder disposed in the oil chamber and cooperating with the first annular face of the cylinder for fixing the end position of the percussion piston during the return stroke; a piston return device consisting of an annular piston having a first side which lies against the cylinder and a second side which lies against the percussion piston, the annular piston being freely displaceable, independently of the percussion piston and being configured for leading the percussion piston during the striking stroke, the annular piston cooperating with the axial abutment face of the percussion piston for moving the percussion piston in the direction of the return stroke, the annular piston having a third side facing the striking tip of the percussion piston which, together with the second annular face of the cylinder, defines axial limits of a piston chamber that is separated from the compressible drive medium and is located between the oil chamber and the second end of the percussion piston, the amount of movement of the annular piston relative to the percussion piston in the direction of the return stroke being limited by the abutment face of the percussion piston; and control means for alternatingly connecting the piston chamber with a pressure source of incompressible driving medium and a pressure-free return conduit, the control means connecting the oil chamber to the return conduit when the cylindrical shoulder of the percussion piston approaches the first annular face of the cylinder during the return stroke and connecting the piston chamber with the pressure source when the annular piston approaches the second annular face of the cylinder.

Accordingly, the basic idea of the invention is to configure the piston return device as an annular piston which is freely displaceable in its longitudinal direction, lies against the percussion piston and against the cylinder and, together with an annular face of the cylinder, axially defines a piston chamber on the side of the annular piston facing the tip of the percussion piston. This piston chamber is separated from the compressible driving medium (compressed gas). The amount of play for movement of the annular piston relative to the percussion piston in a direction opposite to the striking direction is predetermined by an abutment face attached to the percussion piston. In addition to the piston chamber, the striking mechanism also includes an oil chamber which is spaced from the piston chamber and which is delimited by the percussion piston and the cylinder. The end position of the percussion piston during its return stroke is defined by a cylindrical shoulder on the percussion piston within the oil chamber.

The piston chamber and the oil chamber have an associated control unit by means of which the oil chamber can be connected to the return conduit when the percussion piston shoulder approaches the rear face of the oil chamber adjacent the piston chamber. Further, by means of the control unit, the piston chamber can be connected with the pressure source when the annular piston, which leads in the striking direction (relative to the percussion piston) approaches the annular face of the cylinder. The annular piston becomes active as a piston return device in that, under influence of the control unit, the piston chamber is charged with pressure from the pressure source and the annular piston, which lies against the abutment face of the percussion piston, carries the percussion piston along, in the return stroke direction, against the force of the compressed gas exerted on the percussion piston in the striking direction.

It is significant with respect to the teaching of the invention that the annular piston employed as a return member has the shape of a simple hollow cylinder. Its length in the axial direction, i.e. in the direction of the longitudinal extent of, for example, the percussion piston, need be only such that proper guidance of the annular piston along the percussion piston and along the cylinder is ensured and the gas chamber accommodating the compressed gas is adequately sealed against the piston chamber.

The terms "gas chamber" and "oil chamber" are here merely intended to express that the respective chambers are charged, or may be charged, with a suitable compressible or incompressible driving medium; the driving medium employed in the piston chamber is also incompressible.

The gas chamber serves to drive the percussion piston in the striking direction once the return stroke is completed, with the freely displaceable annular piston, due to its smaller mass, initially being accelerated faster in the striking direction. Consequently, it moves ahead of the operating stroke movement of the percussion piston.

Advisably, the control unit is composed of a hollow slide which is movable in a control chamber and which, when the annular piston approaches the annular cylinder face, can be displaced into a return stroke position and, in the opposite direction into an operating stroke position when the percussion piston shoulder approaches the rear face of the oil chamber. Several pressure and return flow channels which are in communication with the pressure source and the return conduit, respectively, open into the control chamber as do four channels, two of which lead to the piston chamber and two to the oil chamber.

The respective operating position of the control unit is therefore a function of the position of the annular piston relative to the annular cylinder face defining the piston chamber and of the position of the percussion piston shoulder relative to the rear face of the oil chamber. The control unit makes it possible to charge the annular piston with pressure as required for the operating (striking) stroke of the percussion piston and to conduct the incompressible driving medium away from the piston chamber and the oil chamber into the pressure-free return conduit.

In one embodiment of the invention, the channels associated with the piston chamber and the oil chamber are arranged and connected as follows:

the mouth of the first piston chamber channel, which is in constant communication with the pressure source, lies farther away from the annular cylinder face than the mouth of the second piston chamber channel;

the mouth of the second oil chamber channel, which is in constant communication with the return conduit, lies farther away from the rear face of the oil chamber than the nearby mouth of the first oil chamber channel which is constantly connected to the pressure source;

the second piston chamber channel is in communication, by way of the control unit, with the pressure source during the return stroke, at least until the operating piston shoulder approaches the mouth of the first oil chamber channel, and, during the operating stroke, at least until the annular piston approaches the mouth of the first piston chamber channel, with the return conduit.

In a preferred embodiment of the invention, the hollow slide, whose interior is in communication with the pressure source, has five different size annular operating faces on its exterior, namely two operating faces for generating pressure forces acting in the direction toward the operating stroke position and three operating faces for generating pressure forces in a direction opposite to the first-mentioned pressure forces which act in the direction toward the return stroke position. The first and second operating faces, which are marked in their sequence in the direction toward the operating stroke position, together are of the same size as the total surface area formed of the third to fifth operating faces; the first and fifth operating faces are composed of the frontal face of the hollow slide which is active in the direction toward the operating stroke and return stroke positions, respectively. By suitably charging the operating faces of the hollow slide, and along with the resulting pressure conditions in the piston chamber and in the oil chamber, the hollow slide can be moved into one of its two end positions, namely the operating (striking) stroke position and the return stroke position, which the hollow slide will retain for the time being. For this purpose, the operating faces of the hollow slide are adapted to one another in size according to the following conditions: the first operating face (i.e. the one frontal face of the slide) is larger than the fifth operating face (i.e. the second frontal face of the slide); the first operating face is smaller than the sum of the third and fifth operating faces; the sum of the first and second operating faces is greater than the sum of the third and fifth operating faces.

According to further advantageous features of the invention, by way of an annular groove of the control chamber, the second and third operating faces can, on the one hand, each be in communication with the pressure source, and on the one hand, with the first oil chamber channel and the first piston chamber channel, respectively; the fourth operating face is simultaneously in communication, via an annular groove of the control chamber, with the second oil chamber channel and with a return flow channel; the second piston chamber channel is in communication with the control chamber by way of first and second annular grooves which, seen in the direction toward the operating stroke position of the hollow slide, lie upstream of the fourth operating face and downstream of the fourth operating face in the vicinity of the fifth operating face, respectively; the control chamber is in communication, by way of a further annular groove, with a return flow channel, with the further annular groove, when seen in the direction toward the operating stroke position of the hollow slide, lying in a region downstream of the annular groove of the first piston chamber channel and upstream of the first annular groove of the second piston chamber channel.

The control action of the hollow slide required for the operating cycle of the percussion piston can further be realized in that the hollow slide is given an external annular groove which is arranged and configured so that the second piston chamber channel is in communication with the return conduit by way of the external annular groove of the hollow slide only if the hollow slide takes on a position at least in the vicinity of its operating stroke position. As soon as the hollow slide has sufficiently approached the operating stroke position, and as long as it is still in a position in the vicinity of its operating stroke position, the piston chamber is connected with the return conduit by way of the external annular groove of the hollow slide, with the consequence that the annular piston moving forward in the striking direction is able to displace the column of fluid disposed in the piston chamber.

A pressure channel equipped with a choke preferably opens into the annular groove of the first piston chamber channel and that of the oil chamber channel. The return flow channels are correspondingly in communication with the return conduit through the intermediary of a choke.

As a preferred feature of the invention, the first oil chamber channel is equipped with a pre-tensioned gate valve with an adjustable displacement force whose operating position can be influenced by way of a control conduit. Corresponding to the selected terminology, the gate valve takes on the flow, or open, position as long as the control pressure in the control conduit does not exceed a given limit value. By means of the gate valve, it is then possible to shorten the operating stroke of the percussion piston and thus to change the striking energy and the number of strokes. As long as the gate valve is in the open position, it has no influence on the operating stroke of the percussion piston; once the gate valve is switched to the blocking position, the connection between the first oil chamber channel and the pressure source is interrupted, independently of the position of the percussion piston shoulder relative to the rear face of the oil chamber, with the consequence that the pressure acting on the second operating face increases and the hollow slide performs a movement in the direction toward its operating stroke position.

The gate valve may here be charged, in particular, through a control conduit connected with the gas chamber. If thus the pressure in the gas chamber, caused by the movement of the percussion piston and of the annular piston during the return stroke, exceeds a given limit value, the gate valve switches into the blocking position thus interrupting the return stroke movement.

The gate valve may advantageously also be remotely operated by way of a control conduit. Such a configuration makes it possible to influence the operating stroke of the percussion piston in the desired manner, either manually or by way of a control unit.

To seal the gas chamber against the piston chamber, the contacting faces between the annular piston and the cylinder as well as the percussion piston are provided with sealing elements.

BRIEF DESCRIPTION OF THE DRAWINGS

The invention will now be described in detail with reference to two embodiments thereof which are illustrated in the drawing figures.

DETAILED DESCRIPTION OF THE PREFERRED EMBODIMENTS

Figure 1:
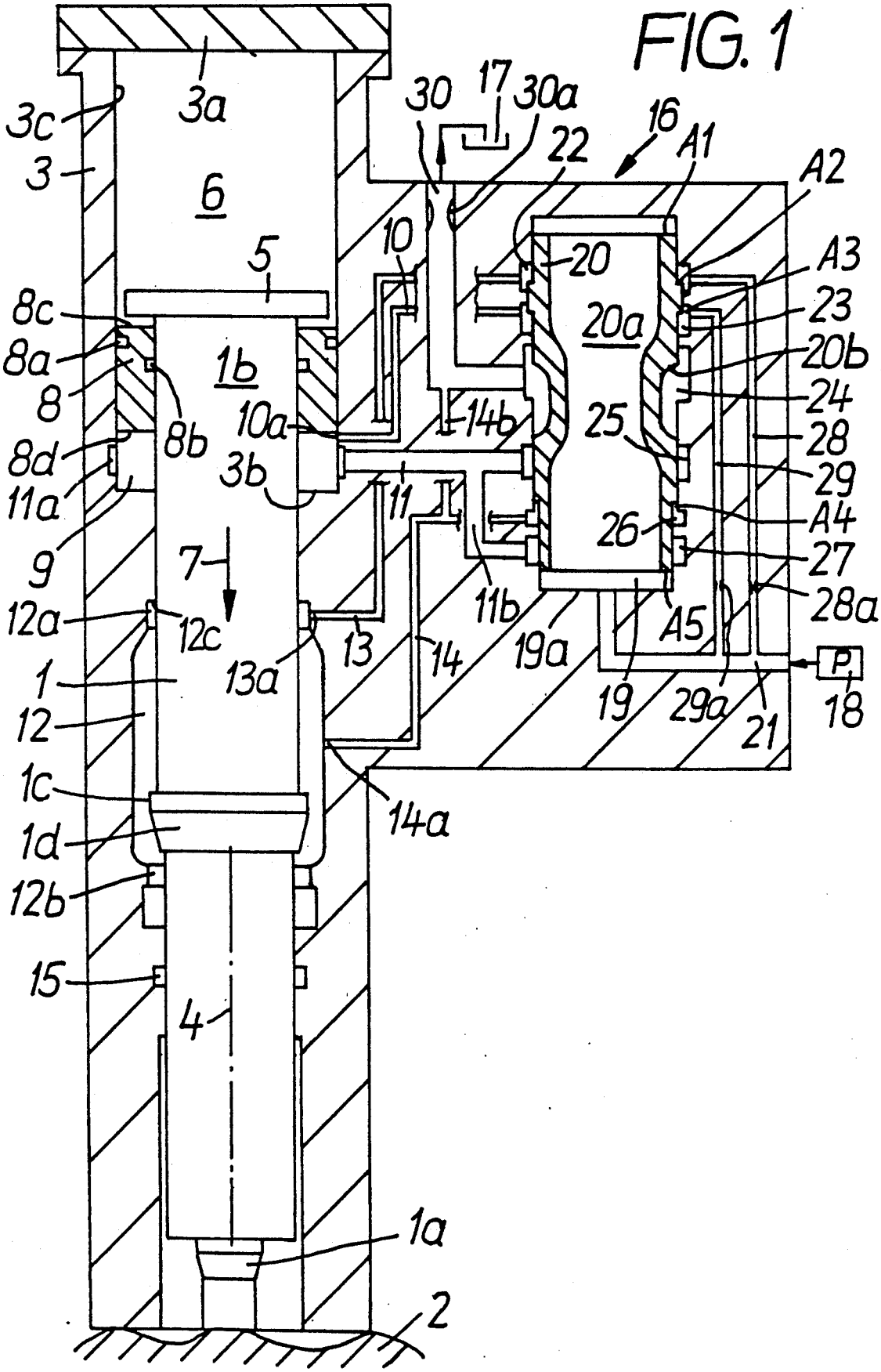
FIG. 1 is a schematic longitudinal sectional diagram showing the basic structure, according to the invention, of a striking mechanism, including the control unit, with the annular piston decoupled.

Referring to FIG. 1, there is shown a striking mechanism which includes a percussion piston 1 having a percussion piston tip 1*a* facing a material 2 to be worked. The percussion piston itself is guided to move back and forth in the direction of its longitudinal axis 4 within a cylinder 3 which is closed by a cover 3*a*.

Percussion piston 1 has a drive side end section 1*b* facing away from percussion piston tip 1*a* and projecting with a disk-shaped contact face 5 fastened thereto into a gas chamber 6 filled with compressed gas. By way of a conduit (not shown), gas chamber 6 can be connected to a compressed gas reservoir (not shown), which in turn can be connected to a compressed gas source (again not shown), and can thus be replenished.

Cylinder 3 has an annular face 3*b* and an interior face 3*c* emanating from annular face 3*b*. An annular piston 8, which is freely displaceably supported at percussion piston 1, as well as at interior face 3*c* of cylinder 3, is disposed in a region between contact face 5 and annular face 3*b* of cylinder 3 and has a frontal face 8*d* facing percussion piston tip 1*a*. Annular piston 8 is sealed against members 1 and 3 by way of sealing elements 8*a* and 8*b*. The length of annular piston 8 in the axial direction is dimensioned so that, without jeopardizing its sealing and guiding function, it has the smallest possible mass.

The amount of play for movement of annular piston 8 relative to percussion piston 1 in the direction opposite to the striking direction is determined by abutment face 5, the diameter of which, while maintaining a sufficient distance from interior face 3*c*, is greater than the diameter of end section 1*b* of the percussion piston. The amount of play for movement of annular piston 8 in the striking direction is limited by annular face 3*b* of cylinder 3. Gas chamber 6 is formed by cylinder 3 and its cover 3*a*, annular piston 8 and percussion piston 1.

Annular piston 8 and annular face 3*b* axially delimit a piston chamber 9 having a variable capacity which is laterally delimited by interior face 3*c* and percussion piston 1 itself. Frontal face 8*d*, which faces annular face 3*b*, forms a movable wall of piston chamber 9.

A first piston chamber channel 10 has a mouth 10*a* which opens into piston chamber 9 and, through the intermediary of an annular groove or mouth 11*a*, into a second piston chamber channel 11 having a mouth 11*a*. Mouth 10*a* of first piston chamber channel 10 lies farther away from annular face 3*b* than mouth 11*a* of second piston chamber channel 11*a*.

Percussion piston 1 together with operating cylinder 3 defines an oil chamber 12 which, seen in the striking direction (arrow 7), follows piston chamber 9 in a spaced relationship. Oil chamber 12 has a rear face 12*c*, remote from percussion tip 1*a* and adjacent annular face 3*b*, in the vicinity of which oil chamber 12 is provided with a first oil chamber channel 13 having a mouth 13*a*, and, spaced therefrom in the striking direction of arrow 7, with a second oil chamber channel 14 having a mouth 14*a*. Mouth 13*a* of first oil chamber channel 13 changes into a cylindrical recess 12*a* in oil chamber 12. Mouth 14*a* of second oil chamber channel 14 lies farther away from rear face 12*c* of oil chamber 12 than mouth 13*a* of first oil chamber channel 13 which lies in the vicinity of rear face 12*c*.

The percussion piston itself is provided with a cylindrical shoulder 1*c* which lies within oil chamber 12 and through which its end position during the return stroke (opposite to the striking direction indicated by arrow 7) is fixed and through which, when it approaches this end position, the mouth 13*a* of the first oil chamber channel can be closed. Recess 12*a* and shoulder 1*c* are here adapted to one another in so that percussion piston shoulder 1*c* can be moved into the mentioned recess with little play. Thus, percussion piston shoulder 1*c* and recess 12*a* form a sort of blocking valve which, in dependence on the position of percussion piston shoulder 1*c* within oil chamber 12, releases or interrupts the connection of oil chamber 12 with first oil chamber channel 13. On its side facing percussion piston tip 1*a*, percussion piston shoulder 1*c* is provided with a frustoconical collar 1*d* which can be inserted with close play into a cylindrical recess 12*b* at the frontal end of oil chamber 12 adjacent percussion piston tip. Together with the movement of collar 1*d* into recess 12*b*, an oil cushion forms in recess 12*b* which counteracts any further movement of percussion piston 1 in the striking direction. The interaction of collar 1*d* and recess 12*b* permits deceleration of percussion piston 1, particularly in the case of an empty stroke. Percussion piston 1 is sealed within operating cylinder 3 by way of a sealing element 15 which, seen in the striking direction (arrow 7), is fixed in cylinder 3 at a distance downstream of recess 12*b* of oil chamber 12.

A control unit 16 follows piston chamber 9 and oil chamber 12 by way of the two piston chamber channels 10 and 11 and the two oil chamber channels 13 and 14. Control unit 16 permits, on the one hand, connection of oil chamber 12 to a pressure-free return conduit 17 when percussion piston shoulder 1*c* approaches rear face 12*c* of oil chamber 12 and, on the other hand, connection of piston chamber 9 to a pressure source 18 when annular piston 8 moving in the striking direction (arrow 7) approaches annular face 3*b*, and additionally connection of oil chamber 12 with pressure source 18.

Figure 2A:
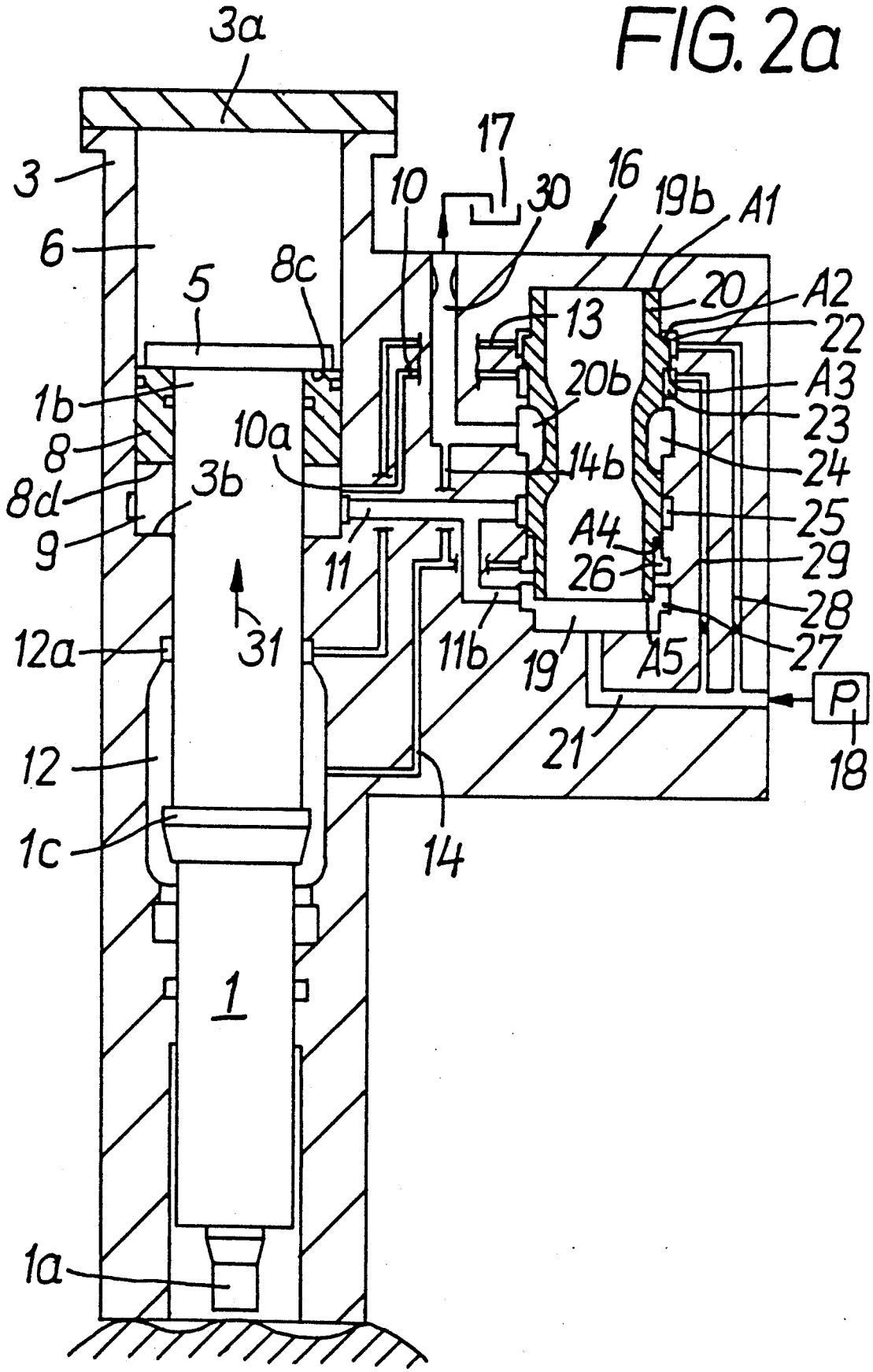
FIG. 2*a* shows the striking mechanism of FIG. 1 during the return stroke movement of the percussion piston and of the annular piston.
Figure 2B:
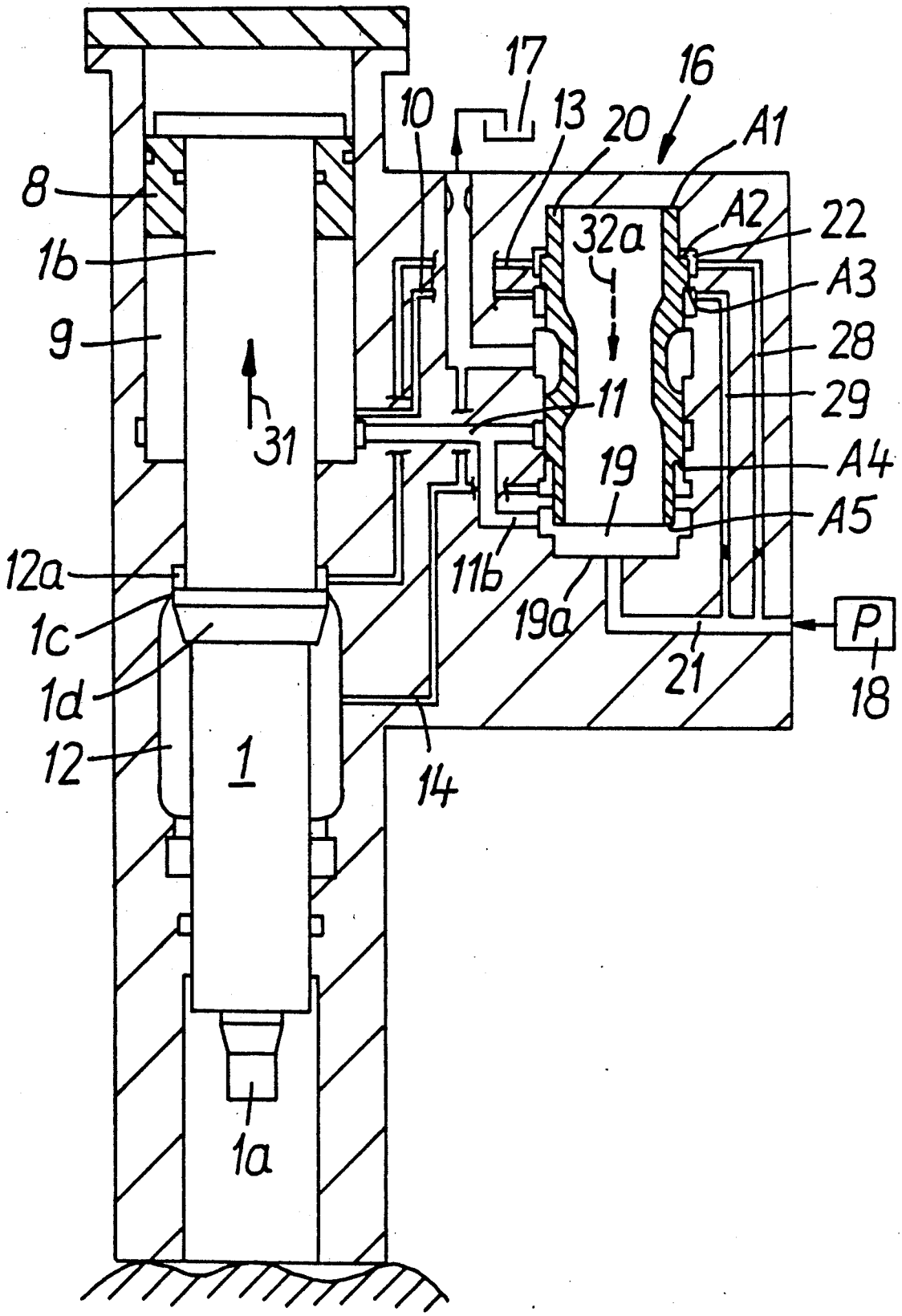
FIG. 2*b* shows the striking mechanism of FIG. 1 with the respective position of the percussion piston and of the annular piston, as well as the state of the control unit after completion of the approach to the return stroke reversal point (inner dead center of the percussion piston).
Figure 2C:
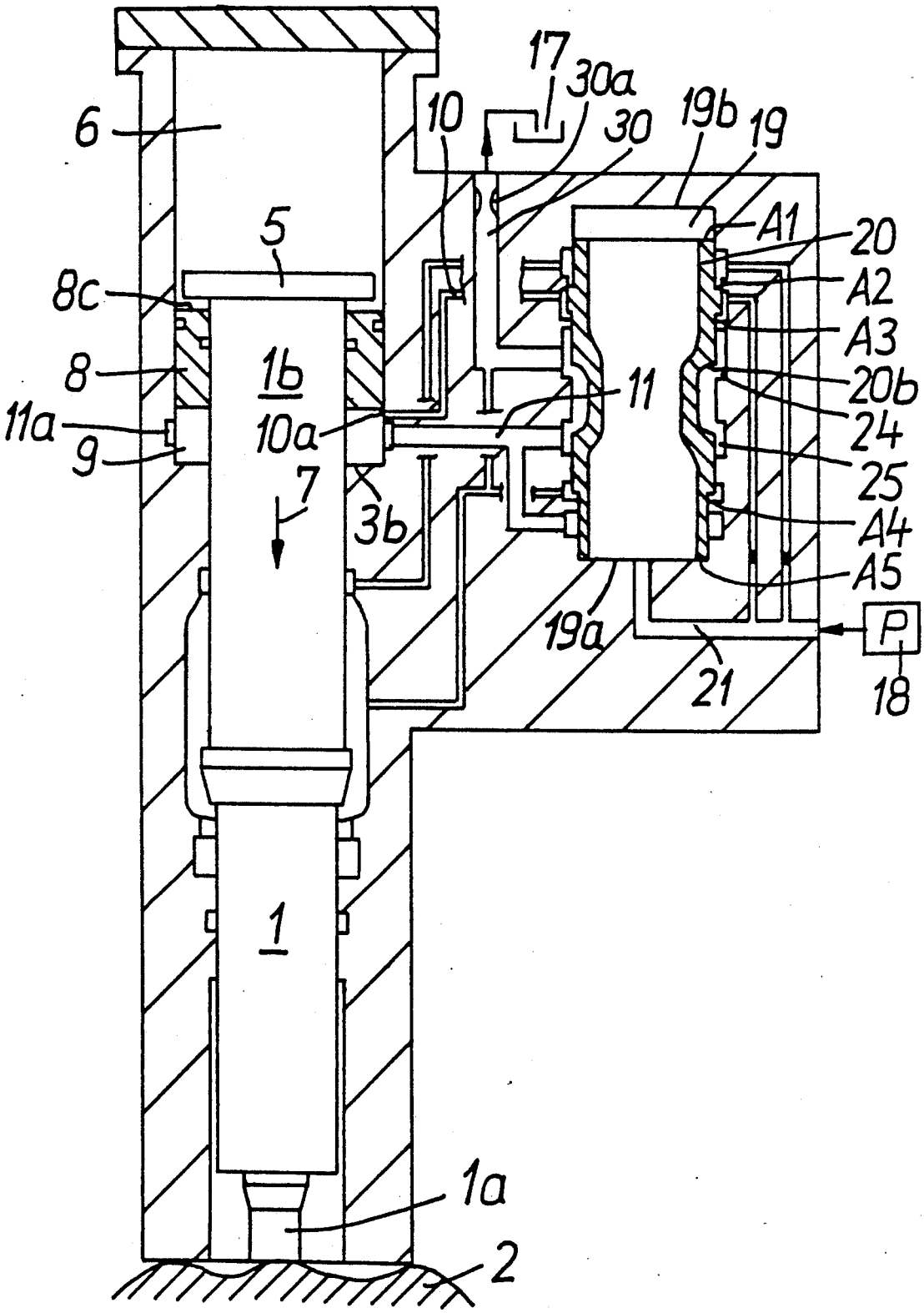
FIG. 2*c* shows the striking mechanism of FIG. 1 with the respective position of the percussion piston and the annular piston, as well as the state of the control unit during the operating stroke.

Control unit 16 is composed of a basically cylindrical hollow slide 20 which is movable in a control chamber 19 and displaceable into two end positions, namely into return stroke position as shown in FIG. 2*a*, and an operating stroke position as shown in FIG. 2*c*. Hollow slide 20 has an interior 20*a* in constant communication by way of a pressure channel 21 with pressure source 18, and has five annular operating faces, namely, in the order as they appear in the direction toward the operating stroke position, a first operating face A1 and a second operating face A2 which both serve to generate pressure forces active in the direction toward the operating stroke position, and third through fifth operating faces A3, A4 and A5, respectively, for generating oppositely directed pressure forces which are active in the direction toward the return stroke position. The first and fifth operating faces A1 and A5, respectively, are formed by the frontal face of hollow slide 20 which is effective in the direction toward the operating stroke position and in the direction toward the return stroke position, respectively; operating faces A2 to A4 project outwardly beyond these frontal faces.

The operating faces are adapted to one another with respect to their size so that they meet the following conditions:

- the first operating face A1 is larger than the fifth operating face A5;
- the first operating face A1 is smaller than the sum of the third and fifth operating faces (A3+A5);
- the sum of the first and second operating faces (A1+A2) is greater than the sum of the third and fifth operating faces (A3+A5); and
- the sum of the first and second operating faces (A1+A2) is as great as the total surface area formed of the third to fifth operating faces (A3+A4+A5).

Seen in the direction toward the operating stroke position of hollow slide 20, control chamber 19 is provided with six annular grooves 22 to 27. By way of annular grooves 22 and 23, the first oil chamber channel 13 and the first piston chamber channel 10 are in communication with one of pressure channels 28 and 29, respectively, which are equipped with a choke 28*a* and 29*a*, respectively. These pressure channels are, in turn, connected with pressure source 18 by way of a pressure channel 21.

Annular groove 24 which has particularly large dimensions in the axial direction changes into a correspondingly dimensioned return flow channel 30 which, in turn, is in communication, through the intermediary of a choke 30*a*, with a pressure-free return conduit 17.

The likewise particularly large second piston chamber channel 11 changes, on the one hand, into an annular groove 25 and, on the other hand, by way of a branch 11b into an annular groove 27. Annular groove 27 is disposed in the vicinity of a frontal face 19a (at the bottom in FIGS. 1 to 2d) against which hollow slide 20 lies in the operating stroke position.

By way of an annular groove 26, control chamber 19 is connected to second oil chamber channel 14 which is additionally in communication, via a branch 14b and return flow channel 30, with return conduit 17.

In the region between operating faces A3 and A4, hollow slide 20 is provided with an external annular groove 20b. This groove is arranged and configured in so that second piston chamber channel 11 is in communication with return conduit 17 only if hollow slide 20 takes on a position at least in the vicinity of its operating stroke position. In this case, piston chamber channel 11 is connected to return conduit 17 by way of annular groove 25, hollow slide annular groove 20b, annular groove 24 and return flow channel 30, with choke 30a being connected therebetween.

The mode of operation of the striking mechanism will now be described with reference to FIGS. 2a to 2d.

During the return stroke or the return movement of percussion piston 1 (FIG. 2a) in the direction of arrow 31, frontal face 8d of annular piston 8 facing the annular face 3b of cylinder 3 is in communication with pressure source 18 by way of piston chamber 9, first piston chamber channel 10, annular groove 23, pressure channel 29 and pressure channel 21. Hollow slide 20 takes on the return stroke position in which it lies with its operating face A1 against the end face 19b (at the top in FIG. 2a) of control chamber 19.

Operating faces A1 and A5 are always charged with the pressure from pressure source 18 because control chamber 19 is in communication with pressure source 18 by way of pressure channel 21. Operating face A2 is connected to return conduit 17 by way of annular groove 22, first oil chamber channel 13, recess 12a, oil chamber 12, second oil chamber channel 14, branch 14b and return flow channel 30.

Annular groove 23 which is charged by pressure source 18 through pressure channels 21 and 29 is also in communication with piston chamber 9 by way of first piston chamber channel 10. Piston chamber 9 is also connected to pressure source 18 by way of branch 11b of second piston chamber channel 11, annular groove 27, control chamber 19 and pressure channel 21. Since the pressure originating from pressure source 18 thus acts on end face 8d of annular piston 8, the latter (whose frontal face 8c is supported at abutment face 5) carries percussion piston 1 along in the direction of arrow 31 against the pressure force emanating from gas chamber 6. By way of annular groove 26, branch 14b of second oil chamber channel 14 and return flow channel 30, operating face A4 is constantly connected to return conduit 17.

Under the condition that the pressure p furnished by pressure source 18 is substantially greater than the pressure in return conduit 17, the following applies for the control force in this operating state:

$$F_{St}=p\cdot(A1-A2-A3)<0,$$

that is, the control force $F_{St}$ is, by definition, oriented so that hollow slide 20 lies against frontal face 19b of control chamber 19.

As soon as, in the course of the return movement, percussion piston shoulder 1c has approached recess 12a at rear face 12c of oil chamber 12 to a sufficient degree, the connection between first oil chamber channel 13 and oil chamber 12 is interrupted with the result that the full pressure p of pressure source 18 builds up in the associated annular groove 22 and acts on operating face A2 (FIG. 2b).

The following relationship then applies for control force $F_{St}$:

$$F_{St}=p\cdot(A1+A2-A3-A5)>0,$$

i.e. hollow slide 20 is shifted in the direction of arrow 32a into the operating stroke position (at the bottom in FIG. 2b), in which piston chamber 9 is in communication with return conduit 17.

During the operating stroke (indicated by arrow 7 in FIG. 2c), operating faces A2, A3 and A4 are in communication with return conduit 17. The control force $F_{St}$ acting on hollow slide 20 here results from:

$$F_{St}=p\cdot(A1-A5)>0,$$

i.e., hollow slide 20 remains in the operating stroke position (at the bottom in FIG. 2c) in which frontal face A5 lies against the lower frontal face 19a of control chamber 19. The pressure in gas chamber 6 acts on abutment face 5 and frontal face 8c of annular piston 8 facing abutment face 5. Due to its smaller mass, annular piston will be accelerated faster in the direction of arrow 7 than operating piston 1, i.e. annular piston 8 runs ahead of the movement of percussion piston 1 in the striking direction. The maximum velocity of the annular piston, and thus the maximum flow velocity of the driving medium for a given flow cross section, is limited by choke 30a in return flow channel 30. Percussion piston 1 is continuously accelerated by the gas pressure until it hits material 2 to be processed and thus is suddenly braked. Annular piston 8, which during the operating stroke is not coupled to percussion piston 1 as far as its movement is concerned, upon approaching annular face 3b initially closes mouth 10a of first piston chamber channel 10 and then also annular groove 11a which forms the mouth of second piston chamber channel 11, so that the movement of annular piston 8 in the striking direction is constantly braked.

Figure 2D:
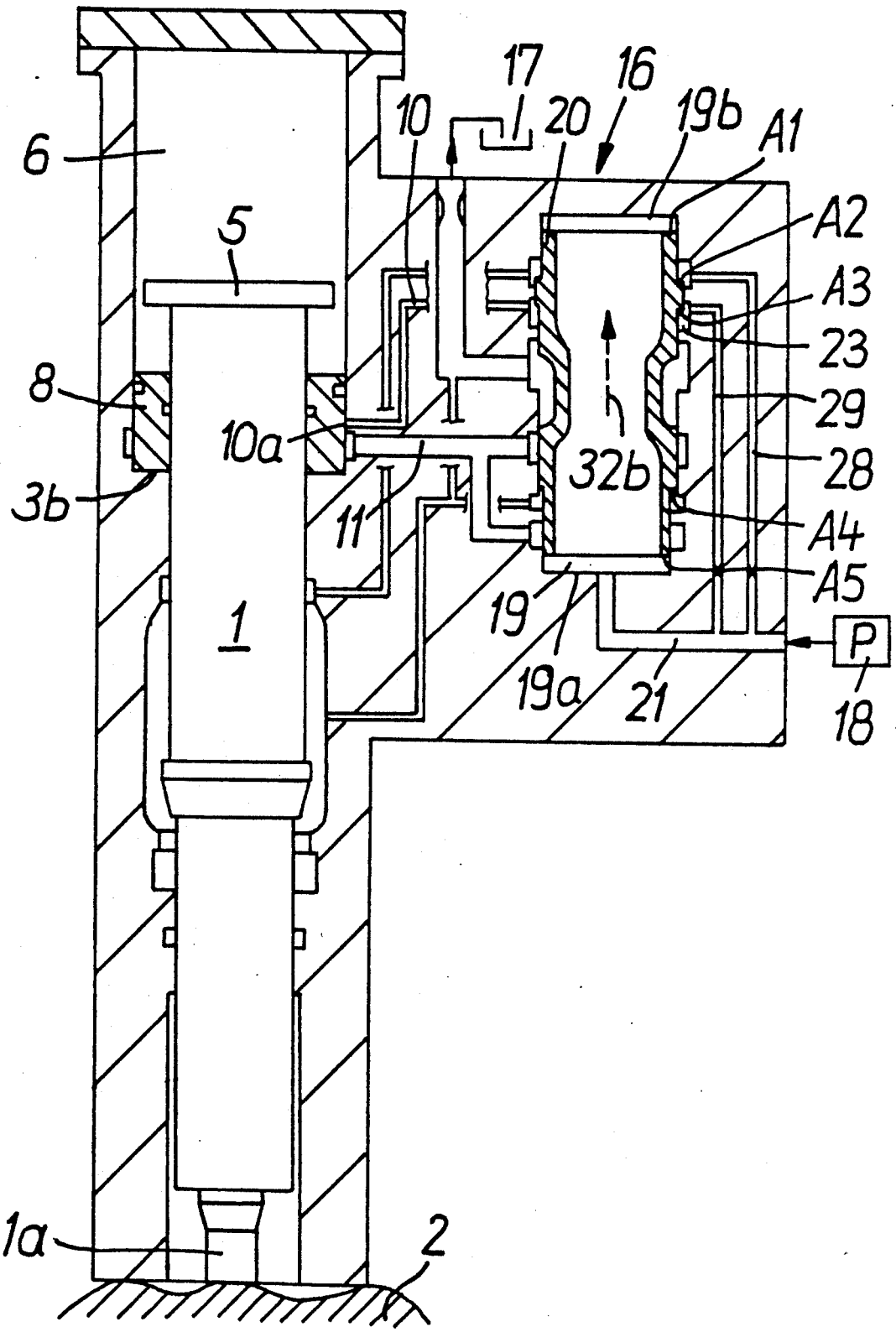
FIG. 2*d* shows the striking mechanism of FIG. 1 with the respective position of the percussion piston and of the annular piston, as well as the state of the control unit after impact of the percussion piston on the material to be worked.

As soon as annular piston 8 has approached annular face 3b of cylinder 3 to such an extent that it closes mouth 10a of first piston chamber channel 10, the pressure existing in annular groove 23 rises to the pressure of pressure source 18. The following thus applies for the control force $F_{St}$ acting on hollow slide 20:

$$F_{St}=p\cdot(A1-A3-A5)<0,$$

i.e., hollow slide 20 is displaced in the direction of arrow 32b shown in FIG. 2d into the return stroke position in which operating face A1 comes to lie against frontal face 19b (shown at the top in FIG. 2d). With respect to the operating state resulting therefrom, reference is made to the statements in connection with FIG. 2a.

Figure 3:
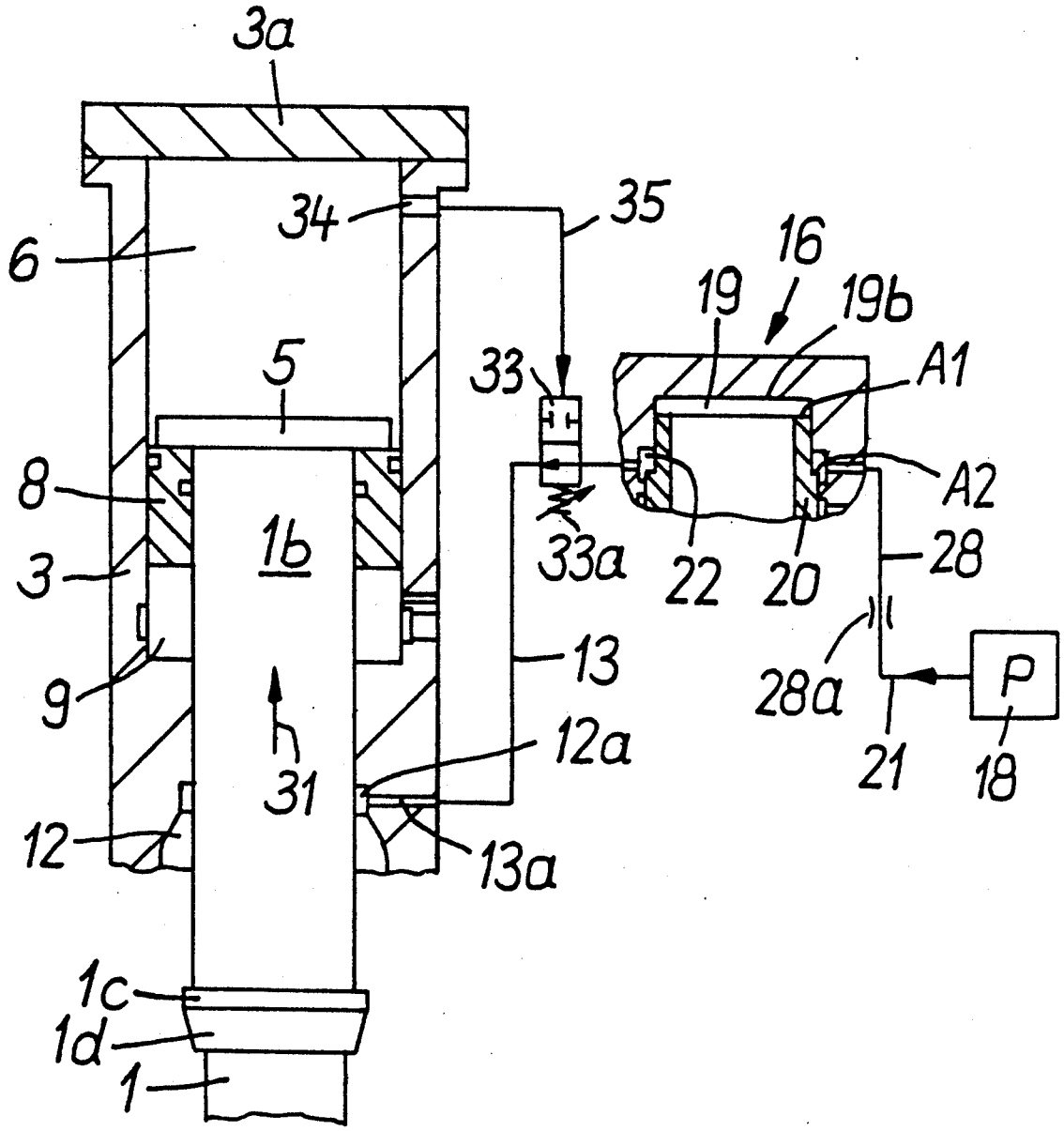
FIG. 3 is a schematic of a partial longitudinal section of a further embodiment of the striking mechanism according to the invention, which, in order to influence the operating behavior, is additionally provided with a gate valve.

FIG. 3 shows an embodiment of the invention in which the operating stroke of striking piston 1 can be varied and thus the striking energy and the number of strokes per unit of time can be influenced.

First oil chamber channel 13 in this embodiment is provided with a gate valve 33 having an operating position predetermined by a spring 33a which has an adjustable pretensioning force. Moreover, gate valve 33 is in communication, by way of a connecting bore 34 and a control conduit 35, with gas chamber 6 in cylinder 3.

As long as the gas pressure existing in gas chamber 6 does not exceed a threshold pressure set by spring 33*a*, gate valve 33 takes on the illustrated passage or open position. In this position, it has no influence on the operating cycle of percussion piston 1.

If, due to the movement of percussion piston 1 and annular piston 8 in the direction of arrow 31, the gas pressure in gas chamber 6 exceeds a threshold value predetermined by pre-tensioning spring 33*a*, gate valve 33 switches over to the blocking position. As a result, the pressure acting by way of annular groove 22 on operating face A2 increases and hollow slide 20 is displaced downwardly (in FIG. 3) in the direction toward the operating stroke position. Correspondingly, the return movement of percussion piston 1 under the influence of annular piston 8 is interrupted and the operating stroke movement in the opposite direction is initiated (see in this connection, FIG. 2*c*).

In deviation from the embodiment of FIG. 3, gate valve 33 may also be operated remotely by way of a control conduit (not shown), either manually or by way of a suitable control unit (not shown), with which it is possible to change the operating position of gate valve 33 after an adjustable period of time.

The present invention may be configured in such a manner that the tip of percussion piston 1 hits material 2 to be worked directly or through the intermediary of a tool, i.e. indirectly.

Obviously, numerous and additional modifications and variations of the present invention are possible in light of the above teachings. It is therefore to be understood that within the scope of the appended claims, the invention may be practiced otherwise than a specifically claimed.

What is claimed is:

1. A hydraulic striking mechanism, comprising:

a cylinder including an interior surface having first and second oppositely facing annular faces;

a percussion piston guided in said cylinder and being movable in said cylinder in one direction for performing a striking stroke and in an opposite direction for performing a return stroke, said percussion piston including a first end having a striking tip for striking an object during the striking stroke, and an opposite, second end presenting an axial abutment face and being charged with a compressible driving medium, said percussion piston defining, with said cylinder, an oil chamber and having a cylindrical shoulder disposed in said oil chamber and cooperating with the first annular face of said cylinder for fixing the end position of said percussion piston during the return stroke;

a piston return device consisting of an annular piston having a first side which lies against said cylinder and a second side which lies against said percussion piston, said annular piston being freely displaceable, independently of said percussion piston and being configured for leading said percussion piston during the striking stroke, said annular piston cooperating with the axial abutment face of said percussion piston for moving said percussion piston in the direction of the return stroke, said annular piston having a third side facing the striking tip of said percussion piston which, together with the second annular face of said cylinder, defines axial limits of a piston chamber that is separated from the compressible drive medium and is located between said oil chamber and the second end of said percussion piston, the amount of movement of said annular piston relative to said percussion piston in the direction of the return stroke being limited by the abutment face of said percussion piston; and control means for alternatingly connecting said piston chamber with a pressure source of incompressible driving medium and a pressure-free return conduit, said control means connecting said oil chamber to the return conduit when the cylindrical shoulder of said percussion piston approaches the first annular face of said cylinder during the return stroke and connecting said piston chamber with the pressure source when said annular piston approaches the second annular face of said cylinder.

2. A striking mechanism as defined in claim 1, wherein said control means comprises: a control chamber and a hollow slide movable in said control chamber and displaceable into a return stroke position when said annular piston approaches the second annular face of said cylinder and into a striking stroke position when the cylindrical shoulder of said percussion piston approaches the first annular face of said cylinder; a plurality of pressure and return flow channels which open in said control chamber and which are arranged for communication with the pressure source and with the return conduit, respectively; first and second piston chamber channels connected between said control chamber and said piston chamber; and first and second oil chamber channels connected between said control chamber and said oil chamber.

3. A striking mechanism as defined in claim 2, wherein:

said first and second piston chamber channels each have a mouth that opens into said piston chamber, the mouth of said first piston chamber channel being farther removed from the second annular face of said cylinder than the mouth of said second piston chamber channel, and said first piston chamber channel being in constant communication with the pressure source by way of said control chamber;

said first and second oil chamber channels each have a mouth that opens into said oil chamber, the mouth of said second oil chamber channel being farther removed from the first annular face of said cylinder than the mouth of said first oil chamber channel, said second oil chamber channel being in constant communication with the return flow conduit and said first oil chamber channel being in constant communication with the pressure source by way of said control chamber; and said second piston chamber channel is in communication with the pressure source by way of said control chamber during the return stroke, at least until the cylindrical shoulder of said percussion piston approaches the mouth of said first oil chamber channel, and said second piston chamber channel is in communication with the return conduit by way of said control chamber during the striking stroke, at least until said annular piston approaches the mouth of said first piston chamber channel.

4. A striking mechanism as defined in claim 2, wherein said hollow slide has an interior in constant communication with the pressure source and an exterior having five different size annular operating faces, first and second ones of said operating faces generating first pressure forces acting in the direction of the operating stroke position of said slide, and third, fourth and fifth ones of said operating faces generating pressure forces acting in the opposite direction as the first pressure forces in the direction toward the return stroke position of said slide, said first through fifth operating faces following one another in order toward the striking stroke position of said slide, with said first and second operating faces together being the same size as the total surface area formed by the third through fifth operating faces, and with said first and fifth operating faces comprising frontal faces of said hollow slide which receive forces in the direction toward the striking stroke position and the return stroke position, respectively, of said slide.

5. A striking mechanism as defined in claim 4, wherein said operating faces are configured relative to one another with respect to their size according to the following conditions:

said first operating face is larger than said fifth operating face;

said first operating face is smaller than the sum of said third and fifth operating faces;

the sum of said first and second operating faces is greater than the sum of said third and fifth operating faces.

6. A striking mechanism as defined in claim 4, wherein:

said control chamber has first and second annular grooves by way of which said second and third operating faces, respectively, are each in communication with the pressure source, said second operating face being in communication with said first oil chamber channel by way of said first annular groove and said third operating face being in communication with said first piston chamber by way of said second annular groove;

said control chamber has a third annular groove by way of which said fourth operating face is simultaneously in communication with said second oil chamber channel and with the return conduit;

said control chamber has fourth and fifth annular grooves by way of which said second piston chamber channel is in communication with said control chamber, with said fourth and fifth annular grooves lying axially on opposite sides of said fourth operating face and said fifth annular groove lying in the vicinity of said fifth operating face; and said control chamber has a sixth annular of which said return conduit is in communication with said control chamber, said sixth annular groove lying in a region between said second annular groove and said fourth annular groove.

7. A striking mechanism as defined in claim 4, wherein said hollow slide includes an exterior annular groove which is arranged and configured so that said second piston chamber channel is in communication with the return conduit by way of said exterior annular groove only if said slide takes on a position which is at least in the vicinity of its striking stroke position.

8. A striking mechanism as defined in claim 6, wherein said plurality of pressure channels includes first and second pressure channels, each including a choke opening, respectively, into said first and second annular grooves.

9. A striking mechanism as defined in claim 2, further including a choke by way of which said plurality of return flow channels are in communication with the return conduit.

10. A striking mechanism as defined in claim 3, wherein said first oil chamber channel includes a pretensioned gate valve having an adjustable displacement force, and further including a control conduit connected with said gate valve for influencing the operating position of said gate valve.

11. A striking mechanism as defined in claim 10, wherein said control conduit is connected with the compressible driving medium for charging the gate valve with pressure so that said gate valve takes on an open position when a minimum pressure value of the compressible driving medium is not reached.

12. A striking mechanism as defined in claim 10, wherein said gate valve can be remotely operated by way of said control conduit.

13. A striking mechanism as defined in claim 1, and further including sealing means for providing a seal between said annular piston and said cylinder and between said annular piston and said percussion piston.

14. A striking mechanism as defined in claim 1, wherein said compressible driving medium comprises a compressed gas.

15. A striking mechanism as defined in claim 1, wherein said cylinder has a rear end remote from the striking tip of said percussion cylinder and said annular piston has a fourth side opposite said third side, and further including a cover closing the rear end of said cylinder and forming, together with the interior surface of said cylinder, the fourth side of said annular piston and the second end of said percussion piston, a chamber for enclosing the compressible driving medium.

* * * * *